US005388667A

United States Patent [19]

Sonnendorfer et al.

[11] Patent Number: 5,388,667

[45] Date of Patent: Feb. 14, 1995

[54] UNLOADING SYSTEM FOR SHOPPING CARTS

[75] Inventors: Horst Sonnendorfer; Franz Wieth, both of Eichenau, Germany

[73] Assignee: Systec Ausbausysteme GmbH, Eichenau, Germany

[21] Appl. No.: 36,987

[22] Filed: Mar. 25, 1993

[30] Foreign Application Priority Data

Mar. 26, 1992 [DE] Germany ..... 4209809

[51] Int. Cl.[6] ..... B65G 67/08

[52] U.S. Cl. ..... 186/64; 186/65; 414/356; 414/385

[58] Field of Search ..... 186/60, 63, 64, 65; 414/355, 356, 375, 385, 390–393, 525.7, 525.8, 574, 582, 583

[56] References Cited

U.S. PATENT DOCUMENTS

| | | | |
|---|---|---|---|
| 684,064 | 10/1901 | Inks | 414/355 |
| 2,832,457 | 4/1958 | Randles | 198/33 |
| 3,263,775 | 8/1966 | Lachance | 186/1 |
| 3,306,398 | 2/1967 | Lachance et al. | 186/64 |
| 3,429,403 | 2/1969 | Drechsler et al. | 414/390 X |
| 3,430,732 | 3/1969 | Lachance et al. | 186/1 |
| 3,443,665 | 5/1969 | Zschaeck | 186/65 |
| 3,513,944 | 5/1970 | McConnaughhay | 180/1 |
| 3,529,331 | 9/1970 | Putin | 25/107 |
| 3,648,862 | 3/1972 | Sugimoto | 414/525.7 |
| 3,770,103 | 11/1973 | Ball et al. | 198/126 |
| 3,810,404 | 5/1974 | Stolzer | 83/71 |
| 3,948,401 | 4/1976 | Spencer | 214/301 |
| 4,044,876 | 8/1977 | Hammond | 193/35 |
| 4,046,248 | 9/1977 | Goffredo et al. | 198/583 |
| 4,353,564 | 10/1982 | Joseloff | 280/79.3 |
| 4,373,611 | 2/1983 | Frederick | 186/64 |
| 4,852,721 | 8/1989 | Stille | 198/782 |
| 5,038,914 | 8/1991 | Cotic et al. | 198/393 |

FOREIGN PATENT DOCUMENTS

| | | |
|---|---|---|
| 2517650 | 6/1983 | France . |
| 2591205 | 6/1987 | France . |
| 722333 | 7/1942 | Germany . |
| 756902 | 2/1954 | Germany . |
| 1848580 | 2/1962 | Germany . |
| 1556588 | 1/1970 | Germany . |
| 2064584 | 7/1971 | Germany . |
| 1683938 | 5/1973 | Germany . |
| 7503940.6 | 6/1975 | Germany . |
| 2163101 | 7/1976 | Germany . |
| 2707817 | 11/1977 | Germany . |
| 2817529 | 10/1979 | Germany . |
| 3637003 | 2/1988 | Germany . |
| 270051 | 7/1989 | Germany . |
| 2-52812 | 2/1990 | Japan . |
| 2-178104 | 7/1990 | Japan . |
| 2-270708 | 11/1990 | Japan . |
| 536239 | 6/1973 | Switzerland . |
| 1397393 | 1/1975 | United Kingdom . |
| 2110727A | 6/1983 | United Kingdom . |
| 2110728A | 6/1983 | United Kingdom . |
| WO87/0724 | 12/1987 | WIPO . |

*Primary Examiner*—F. J. Bartuska

*Attorney, Agent, or Firm*—Marshall, O'Toole, Gerstein, Murray & Borun

[57] ABSTRACT

The invention is directed to an unloading system for shopping carts wherein a conveyor device is disposed in the entry area of a cash register or scanning apparatus, and acts on the products lying randomly in the shopping cart to subject them to a transporting motion in a defined unloading direction, whereby a side wall of the basket in this direction is to be opened.

27 Claims, 5 Drawing Sheets

UNLOADING SYSTEM FOR SHOPPING CARTS

BACKGROUND OF THE INVENTION

1. Field of the Invention

The invention is concerned with an unloading system for shopping carts, in which the products to be unloaded are arranged randomly in a basket that is open on top.

2. Description of Related Technology

In numerous supermarkets, typically in North America and in parts of Asia, the customer does not have to unload the shopping cart before the cash register, as this work is done by supermarket employees. However, because of the high cost for personnel, this service is rarely encountered in Europe and in many areas of the United States. Therefore, the customer has to remove the products from the cart and place them onto a conveyor belt moving toward the cash register or scanning apparatus. For heavy items such as six-packs of beverages, for example, and in case of elderly or infirm customers, this becomes difficult and may result in delays at the cash register.

SUMMARY OF THE INVENTION

It is an object of the invention to overcome one or more of the problems described above.

Accordingly, the present invention provides, as a customer service, an unloading system for shopping carts, which transports the products automatically, i.e., without manual aid, from the cart and transfers them directly to the cash register or scanning area or onto the usual conveyor systems used there. The typical shape and structure of the customary shopping cart, especially the tapered contour, may be largely retained, in order to permit space-saving stacking of carts in a row.

According to the invention, a transport device is brought into working contact with the products to be unloaded, which subjects the products to a transporting motion in a defined unloading direction, while a side of the basket in the unloading direction (relative to the products to be unloaded) can be opened at least near the bottom of the basket.

Since each cart need not be equipped with its own unloading device, a single unloading system for each cash register station is sufficient. Given the large number of shopping carts that must be available in each supermarket, this advantage results in significant savings relative to equipping each cart with an unloading device. Moreover, the unloading principle described is suitable for all forms of shopping carts; the only important design change is that the basket must be opened in the area through which the products are to be discharged from the cart. Expediently, this is done on the rear (handle) side of the basket due to its typically larger cross-section when it tapers toward the front side of the basket. According to the invention, this (or another) side wall opens not toward the inside, but toward the outside, that is, to the side, upwardly or downwardly.

Other objects and advantages will be apparent to those skilled in the art from the following detailed description, taken in conjunction with the drawings and the appended claims.

DETAILED DESCRIPTION OF THE INVENTION

Figure 1:
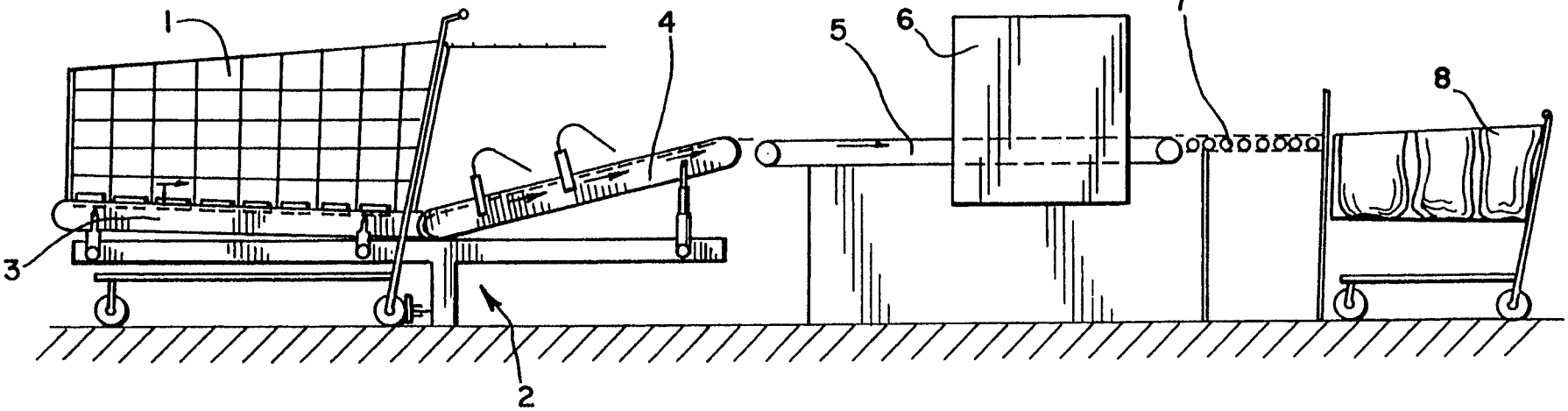
FIG. 1 is a schematic illustration of an unloading system of the invention taken from a side view.

Two general alternatives for the structural design of the transporting device of the invention will be described. It is especially preferred to design the transporting device as a vibrating transporting device, which has a vibrational amplitude preferably less than about 1 mm (e.g., highly preferably about 0.05 to about 0.6 mm) and a frequency preferably greater than about 1 Hz (e.g., less than about 100 Hz, highly preferably less than about 10 Hz) and gradually moves the products in a sequence of microjumps to an open side of the basket. This results in very protective handling of the products, because the amplitude of the vibration produced is extremely low and, in addition, the vibration results in loosening of the products in the sense that individual products are separated from each other. The vibrating conveyor also has the advantage that the external shape of the products has practically no influence on its operation.

The vibrating conveyor device can effect vibration of the entire shopping cart, only the basket, or only the floor (i.e. the bottom wall) of the basket, especially when the floor of the basket is elastically mounted in the cart. It is also within the scope of the invention to transfer the vibrational forces onto the cart without contact, e.g. via electromagnetic forces.

In the case of carts where the basket is defined by the usual grid structure defined by a mesh of rods or the like, the vibrating conveyor device may be brought into direct contact with the product with the aid of a plurality (usually a large number) of upwardly-directed projections protruding through the grid openings. In this case the vibrations are directly transferred to the products, and the cart itself is more or less unaffected. In practice, this is done such that when the cart with its basket is introduced to the unloading station, it will come to a stop directly above the vibrating conveyor device and then the unloading device is lifted or the cart is lowered. As a result, but at least by the transporting motion itself, the products are somewhat lifted, so they are not caught on the rods defining the grid of the bottom wall of the cart.

Another embodiment of the conveyor device of the invention provides in baskets which have openings on the floor or bottom wall thereof, and especially in baskets which have a grid structure on the bottom wall, a number of upwardly protruding small rollers, balls, or cams that can be brought into contact with the products through the openings of the bottom of the basket, similarly to the vibrating protrusions describe above, where the small rollers, balls, or cams effect a rolling or swinging motion with the aid of an external drive means, or transport the products to the open side of the basket due to the incline of the bottom of the basket alone.

In this connection, it is within the scope of the invention to vary the transporting velocity of the protrusions, small rollers, balls, or cams, especially in such a way that a higher conveyor efficiency is achieved in the open end (in the unloading direction) of the basket than in the opposed closed end of the basket. As a result, the products will be separated and the danger of products lying on top of one another and following when they leave the basket is reduced.

The protrusions, small rollers, balls, or cams lie on a plane surface, the size of which corresponds approximately to that of the bottom of the basket, and are a few millimeters smaller than the mesh (i.e., the grid openings) of the basket, so that the cart itself will be largely at rest during the unloading process. Expediently, the protrusions, rollers, balls, or cams are components of a vibrating plate or a roller conveyor.

Preferably, the unloading system is provided with a lifting device which permits positioning of the cart (supported by tracks and stops) flush over the conveyor device, whereupon the conveyor device is lifted up so that it comes into direct or indirect working contact with the products. When doing this, the cart can also be lifted and somewhat inclined if desired in order to promote unloading.

In another embodiment of the invention, the unloading system itself is designed as a lifting device to tilt the shopping cart, so that the slope of the bottom of the basket toward the open side of the basket is increased, namely by more than about 5°, preferably by about 10° to about 25°. As a result, especially if the bottom of the basket is smooth, such an incline can be produced by mere tipping of the cart such that the products will slide out from the open basket without additional aid.

Since the shopping cart is normally pushed to the cash register in the forward direction, but the unloading is mostly done from the rear (handle) side of the cart, it is preferred that the unloading system also have a rotating device with which the cart, pushed against stops, can be rotated by up to 180° around its vertical axis. This rotating device can be combined with the lifting device.

Furthermore, it is preferred to combine the conveyor device with an opening mechanism which automatically lifts a side wall (which may define the front or rear) of the basket, which is in the unloading direction relative to the products in the basket, lowers it or swings it outward, or opens the bottom of the basket. A one-part or multi-part conveyor belt attached at the open side may be provided to bring the products to the cash register or scanner. This conveyor belt may be equipped as a precaution with means for separating the products, especially to strip off products that lie on top of one another, so that they can be detected automatically by a scanner. The conveyor belt can be designed as a conventional conveyor belt, or as a vibrating conveyor belt.

For this conveyor belt, as well as in the case of the vibrating conveyor belt that engages the grid openings of the basket, it may be expedient to provide the surface with a scale or brush-like surface which is oriented in such a way that the holding force against the direction of transport (i.e., the unloading direction) is greater than in the direction of transport, that is, which will support forward movement.

Turning now to the drawings, FIG. 1 shows a complete unloading system of the invention. On the left hand side of FIG. 1 is a shopping cart 1 having a basket to be unloaded, which enters an unloading station 2 opposite to its usual direction of travel, that is, with the handle-side to the front (relative to the unloading direction), i.e. to the right-hand side of FIG. 1. Thus, the cart basket lies vertically above a vibrating conveyor 3, which is followed by a rising conveyor belt 4 and a horizontal conveyor belt 5, onto which products are transferred by the belt 4. The belt 5 illustratively passes through a scanner tunnel that is connected to a cash register. A roller conveyor 7 loads the products into an outdoor cart 8 or into another shopping cart 1.

Figure 2:
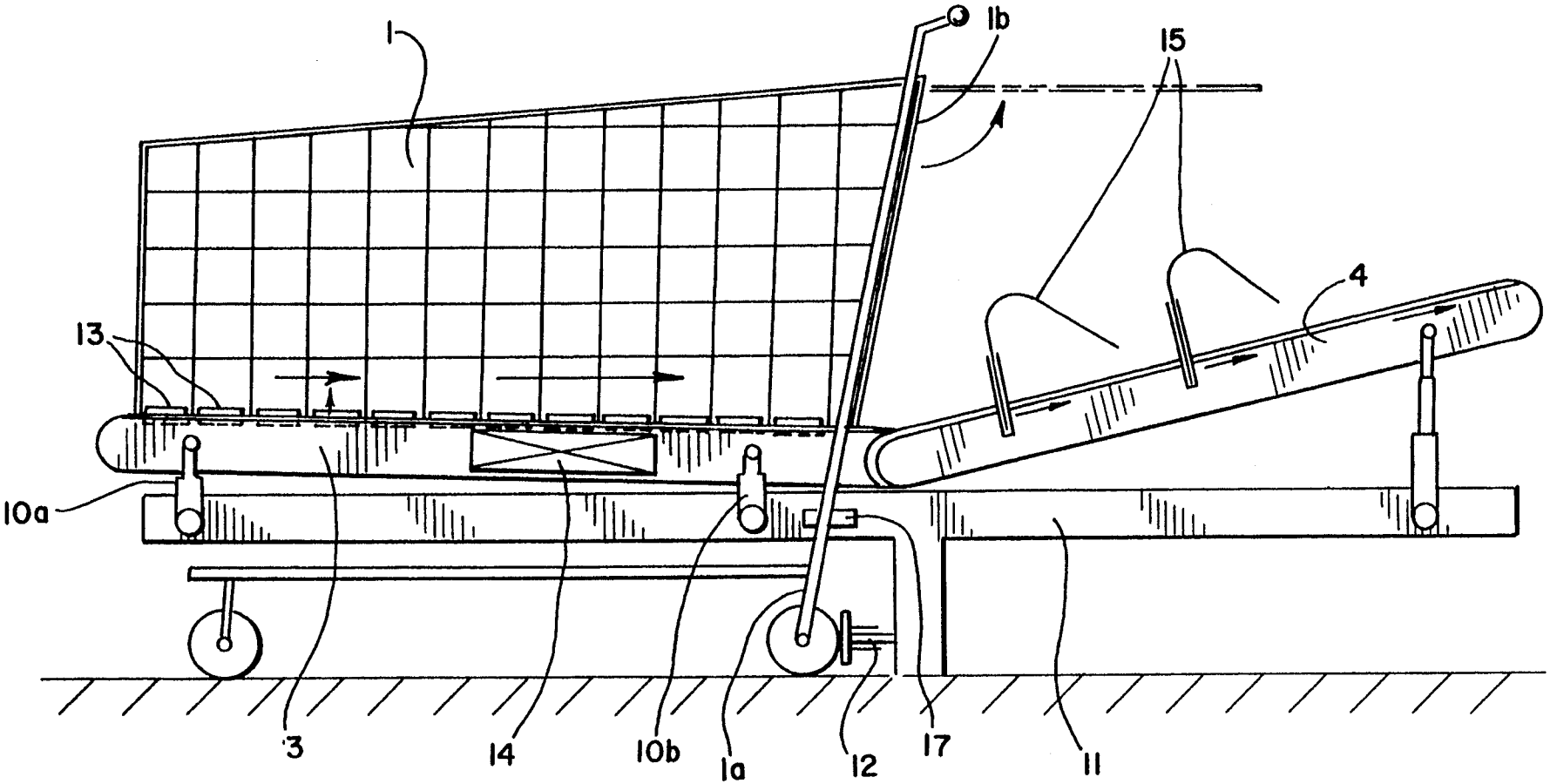
FIG. 2 is an enlargement of a section of FIG. 1.
Figure 3:
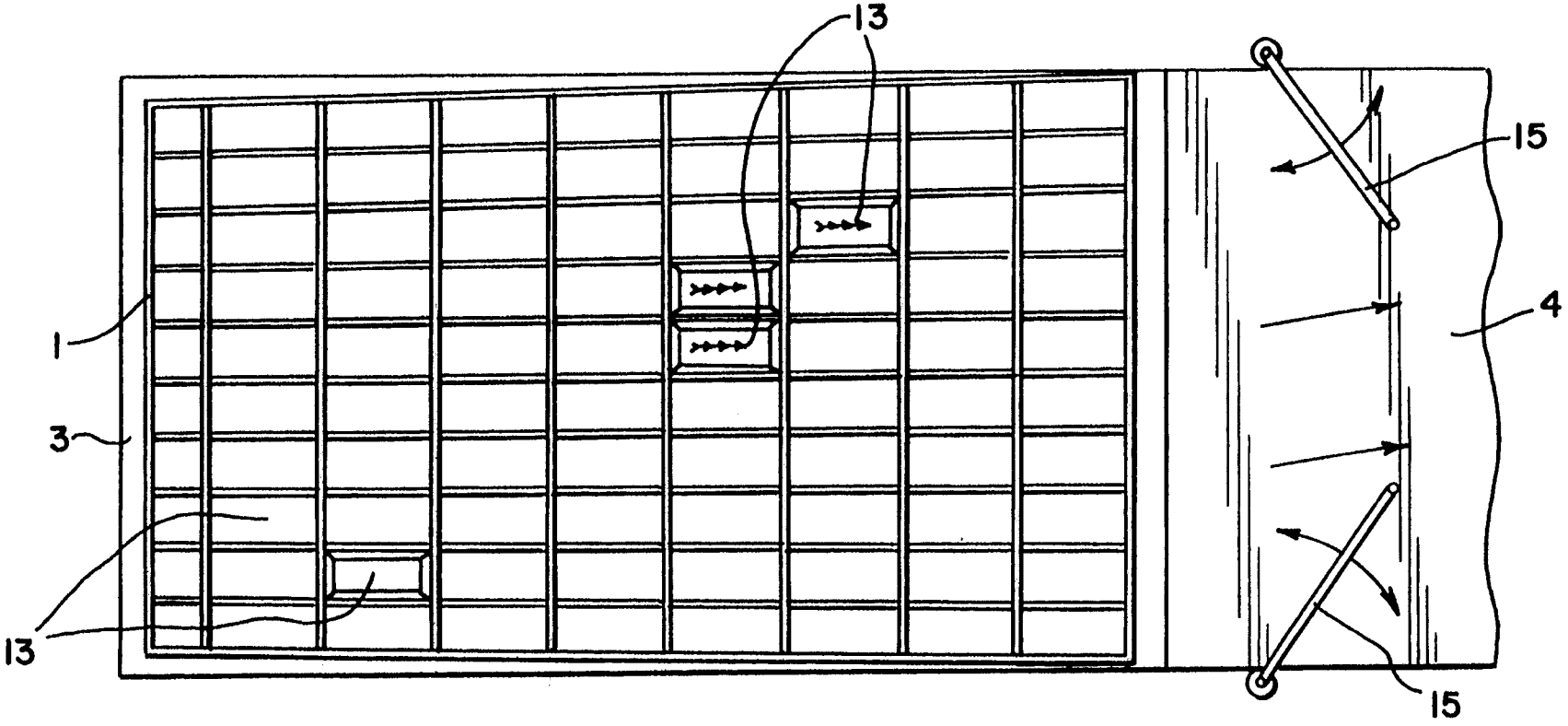
FIG. 3 is a somewhat enlarged top view of the illustration of FIG. 2.

Details of the actual unloading system of FIG. 1 are shown in FIGS. 2 and 3 wherein the vibrating conveyor 3 is mounted on electrical lifting elements 10*a* and 10*b* on a base frame 11. The base frame 11 is dimensioned so as to serve as a guide for the entry movement of the shopping cart 1, so that the cart 1 is positioned above the vibrating conveyor 3. In the illustrated embodiment, the base frame 11 comes into sliding contact with the frame of the cart, by penetrating into spaces defined by the elements of the frame. In addition, the frame 11 has a contact 12 which cooperates with a stop for the inlet movement of the cart and triggers the unloading process.

The unloading process begins by lifting the vibrating conveyor 3 into the indicated position. A plurality of vibrating elements 13 then lift the contents of the basket (not shown) a few millimeters above the bottom of the basket. The elements 13 are set into high-frequency vibrations in a known manner by a generator 14. The vibrations having an amplitude of fractions of a millimeter (i.e., preferably less than about 1 mm, highly preferably in the range of about 0.05 mm to about 0.6 mm), so that the products assume an intended forward movement in the direction of the large arrow, that is, to the handle end of the shopping cart basket. At the same time, a side 1*b* of the basket located at the forward (handle) end of the cart is rotated upwardly by gripping control elements (not shown) into the position shown by the dotted lines, so that the basket of the shopping cart will be open at the end where the handle is located.

Furthermore, the rising conveyor belt 4 accepts the products delivered by the vibrating conveyor 3, separates them, and finally transfers them to the conveyor belt 5 in the cash register area. For this purpose, the conveyor belt 4 is equipped on both sides with several swinging arms 15. These swinging arms are pressed with a spring force into the area above the conveyor belts, but they can also deviate somewhat around their vertical rotary axis. Products lying loosely on top of one another are thereby stripped off protectively and separated.

After emptying the shopping cart, the vibrating conveyor 3 is swung downwardly, so that the bottom region of the cart is freed. At the same time, the cart side wall 1*b* can be swung back again and preferably can be locked in the closed position. The cart 1 is then moved out from the unloading station in the direction opposite to that of the large arrow.

Figure 4:
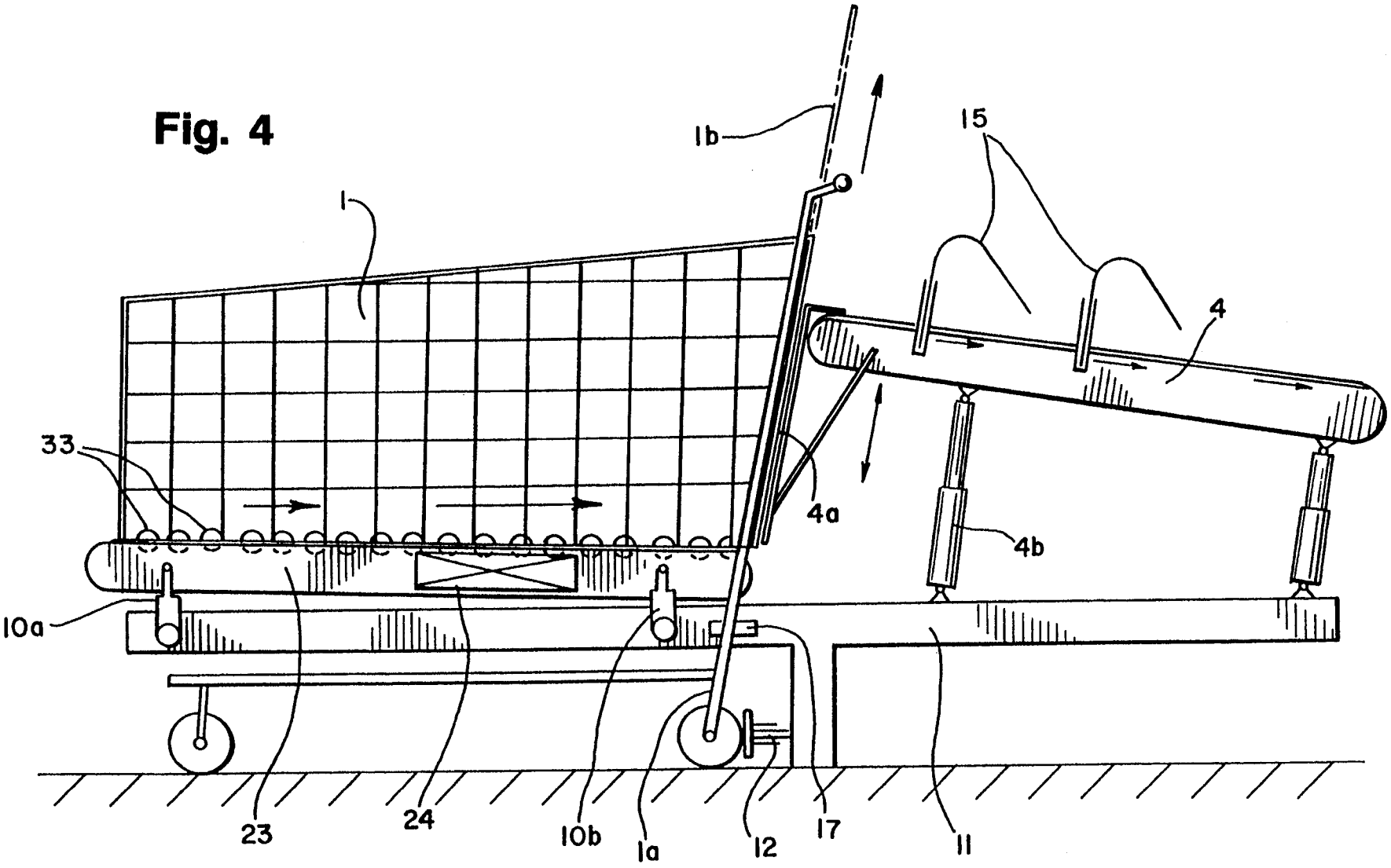
FIG. 4 is a schematic illustration of an alternative embodiment of the invention.

FIG. 4 shows an alternative embodiment of the unloading system of the invention. Elements corresponding to those of FIGS. 2 and 3 are designated with the same reference numerals in FIG. 4. The embodiment of FIG. 4 differs from that of FIG. 2 in the way the forward movement is produced. Instead of the vibrating projections 13, a large number of spheres (balls) or small rollers 33 are provided on an unloading device 23 in such a way that the upper circumference of the small spheres or rollers 33 protrude in almost each grid opening of the bottom of the basket when the unloading device 23 has been lifted into its upper, operating position, as shown. Neighboring small rollers 33 can be mounted on a common shaft so that rows of parallel shafts are disposed in the unloading device 23. The shafts are operated through drive means 24, with all shafts moving in the same rotational direction i.e., in the direction designated by the arrows, so that the products are gradually moved toward the open end of the basket to the right hand side of FIG. 4.

It is possible to rotate the small spheres or rollers that are disposed nearer the exit of the basket somewhat faster than those at the opposite end of the basket, so that the products are somewhat separated even within the basket.

Similarly, it is also possible to use cams or eccentrics instead of the small spheres or rollers 33, all rotating in the same direction. Also, instead of the same rotational movement, one can also provide a back and forth ("to and from") swinging movement when the conveyor elements are moved down during their movement against the direction of transport and as a result they will not be in contact with the product.

Instead of an external drive for the small rollers, the roller conveyor together with the bottom of the basket can be inclined more steeply toward the open side, so that transport of the products is effected by gravity alone.

It is also within the scope of the invention to stop the cart in the unloading station by other guide and holding means, not shown in the drawings. Thus, it may be especially expedient to secure the cart in its position after reaching the end position intended for unloading, as by a safety hook, as is indicated in FIG. 2 by reference numeral 17.

It is also within the scope of the invention to design the lifting elements 10*a* and 10*b* in such a way that the vibrating conveyor 3 lifts the cart somewhat from the floor so that the unloading of the cart occurs in the lifted position.

In addition, FIG. 4 shows that the basket can also be opened by lifting a side wall 1*b* upwardly. To prevent the lifting up of the products stacked in the basket during lifting of the side wall 1*b*, the conveyor belt 4 is provided with a downwardly protruding apron 4*a* at the end that is near or adjacent the basket. It is to be positioned such that, during lifting of side wall 1*b*, the opening in the basket is covered at least up to two-thirds of the basket height. During this process, the conveyor belt 4 is held in the position shown by the lifting elements 4*b* until the side wall 1*b* reaches the open position shown by the dotted lines. Then, the lifting elements 4*b* can lower the end of the conveyor belt near the basket until it reaches the position shown in FIG. 1, whereby the attached apron 4*a* is also lowered and thus the opening of the basket is freed.

The unloading system (i.e., either the vibrating conveyor 3 or the small spheres or rollers 33) is already operating on during the lowering movement of conveyor belt 4, as is the conveyor belt 4 itself. As a result, the stacked products are unloaded from the basket before the conveyor belt 4 has reached its lowered position. During this time, the apron 4a is taken up in the corresponding recesses, intermediate spaces, or the like of the frame 11, but it can also be closed telescopically. It is important that when the side wall 1*b* is lifted, the free cross-section of the basket be covered for a period of time by the apron 4*a*, so that the stacked products cannot fall out.

Figure 5:
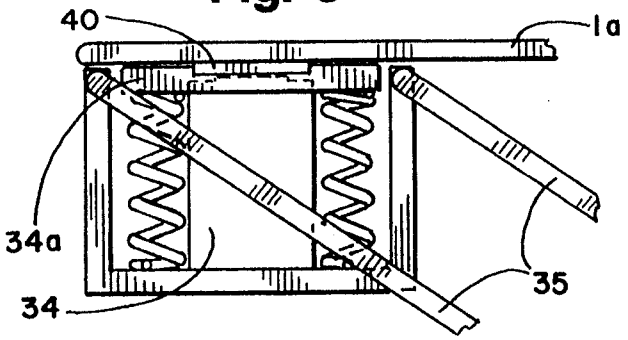
FIG. 5 is a schematic view of a further embodiment of the invention.

FIG. 5 illustrates an alternative embodiment in which pulses from a vibrating conveyor are transferred to the products in such a way that the shopping cart or elements thereof are set into a vibrating motion. It may also be expedient to couple only the basket or the bottom of the basket to the vibrating conveyor. In FIG. 5, the vibrations are transferred to an element of the frame 1*a* of the cart 1. The vibrating conveyor includes in this case a vibrating magnet 34 which has on its upper end a vibrating spring-loaded undercarriage fixture 34*a*, which rests on springs 34*b* which couple it to a lifting device 35. As a result, the magnet 34 can be swung onto the frame or the undercarriage of the cart, so that its fixture 34*a* carries a metal element 40 of the cart. The vibrating magnet 34 can lie flat on the fixture 34*a*, but it can also be positioned at a small distance from it, so that the transfer of vibration occurs without contact, but merely through electromagnetic forces.

Instead of the illustrated vibrating magnet, other vibrating conveyors, driven by eccentric means or the like, can be used.

Figure 6A:
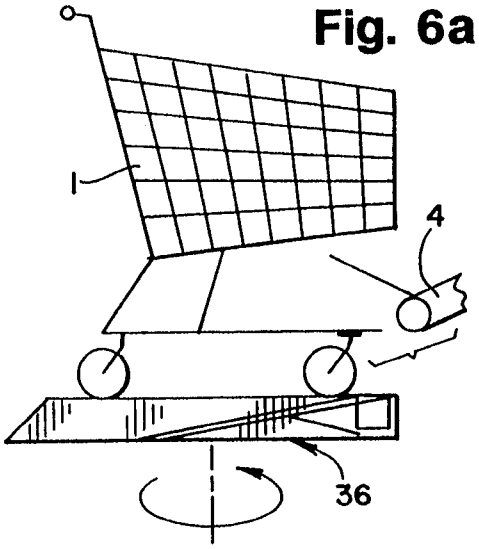
FIG. 6 is a schematic view of a lifting and rotating device useful in the invention.

FIG. 6 shows how the lifting device 35 described above is integrated into a combined rotating and lifting device 36. In FIG. 6*a*, a cart 1 is shown in the position when it is pushed into the cash register region from the left when the automatic unloading is to begin. The beginning of the conveyor belt 4 onto which the products are placed from the vibrating conveyor device is also shown.

Figure 6C:
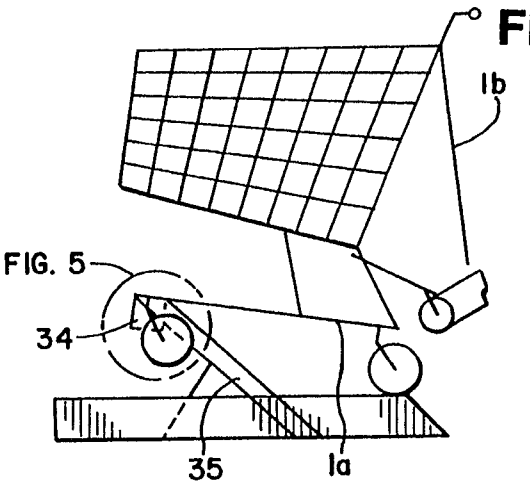
Figure 6B:
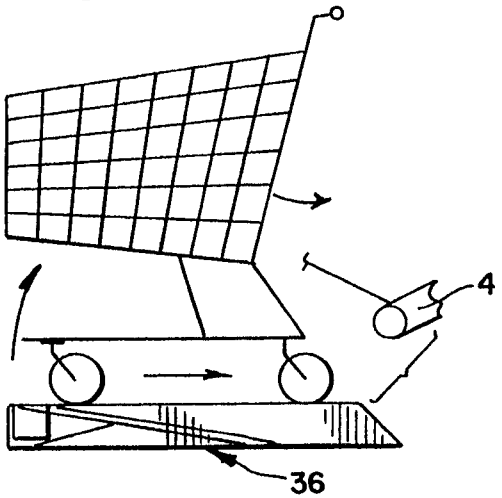

The rotating and lifting device is shown schematically by reference numeral 36, and rotates the cart by 180° around its vertical axis into the position shown in FIG. 6*b*, i.e., such that the rear wall 1*b* of the basket to be opened faces the unloading conveyor belt 4. Then, or before, the lifting device 35 lifts the front end of the cart, so that the bottom of the basket will be inclined at a higher angle to the opening side, and also brings the generator for the vibrational movements of the cart (i.e., the vibrating magnet 34 in this case) in contact with the cart frame 1*a*, as shown in FIG. 6*c*.

At the same time, with the aid of an opening mechanism (not shown), the rear wall 1*b* is unlocked and swivels up toward the outside, illustratively toward the back. Similarly, it is within the scope of the invention to open the basket in such a way that an element of the side wall opens to the right or left, upwardly or downwardly, or that the basket floor is lowered relative to at least one of the side walls of the basket.

After unloading, the combined rotating and lifting device 36 lowers the cart and rotates it back into its initial position.

It is common to all embodiments of the invention that the basket is opened automatically at least on one side and that the products are transported out from the basket on this side, again automatically.

The foregoing detailed description is given for clearness of understanding only, and no unnecessary limitations should be understood therefrom, as modifications within the scope of the invention will be apparent to those skilled in the art.

We claim:

1. An unloading system in combination with shopping carts which comprise an undercarriage, an upwardly open basket having a generally horizontal product-supporting bottom wall, and a plurality of generally vertical sidewalls extending upwardly from said bottom wall, said basket containing products to be unloaded lying randomly therein on said bottom wall, said system comprising a vibrating conveyor device adapted to be operatively associated with the products to be unloaded to subject the products to a transporting movement in a defined unloading direction, and wherein a side of the basket disposed in the unloading direction relative to the products is adapted to be opened at least in the area adjacent the bottom wall of the basket.

2. The unloading system of claim 1 wherein said shopping carts are adapted to be pushed into one another for stacking.

3. The unloading system of claim 1 wherein the vibrating conveyor device has a vibration amplitude less than about 1 mm, and has a frequency greater than about 1 Hz.

4. The unloading system of claim 3 wherein said amplitude is in the range of about 0.05 to about 0.6 mm and said frequency is about 100 Hz or less.

5. The unloading system of claim 4 wherein said frequency is about 10 Hz or less.

6. The unloading system of claim 1 wherein the vibrating conveyor device acts on the products through the shopping cart.

7. The unloading system of claim 6 wherein the vibrating conveyor device is adapted to be coupled to the undercarriage or to the basket.

8. The unloading system of claim 6 wherein the vibrating conveyor device acts on the shopping cart through electromagnetic forces.

9. The unloading system of claim 8 wherein the vibrating conveyor device is free of direct contact with the shopping cart.

10. The unloading system of claim 1 wherein the basket has openings in the bottom wall thereof and the vibrating conveyor device is adapted to be brought into contact with the products with the aid of a plurality of vibrating projections protruding upwardly through the bottom wall openings.

11. The unloading system of claim 10 wherein the bottom wall of the basket defines a grid.

12. The unloading system of claim 1 wherein the conveyor device defines a lifting device for inclining the shopping cart.

13. The unloading system of claim 1 wherein the conveyor device is provided with a lifting device for bringing the conveyor device into operative association with the shopping cart.

14. The unloading system of claim 13 wherein the lifting device is combined with a device for rotating the shopping cart.

15. The unloading system of claim 1 wherein the spatial arrangement of the shopping cart relative to the conveyor device is effected through adjustable guides and stops.

16. The unloading system of claim 1 wherein the conveyor device is combined with a mechanism for opening a side of the basket.

17. The unloading system of claim 1 disposed in the entry region to a cash register or a scanner.

18. A shopping cart with a basket open on the top for transporting products wherein a bottom wall or a side wall of the basket is adapted to be opened at least in a bottom region of the basket in combination with an unloading system according to claim 1.

19. The shopping cart of claim 18 wherein the wall to be opened is to be opened to the outside.

20. The shopping cart of claim 19 wherein the wall to be opened is a side wall.

21. An unloading system in combination with shopping carts which comprise an undercarriage, an upwardly open basket having a generally horizontal product-supporting bottom wall, and a plurality of generally vertical sidewalls extending upwardly from said bottom wall, said basket containing products to be unloaded lying randomly therein on said bottom wall, said system comprising a conveyor device adapted to be operatively associated with the products to be unloaded to subject the products to a transporting movement in a defined unloading direction, wherein a side of the basket disposed in the unloading direction relative to the products is adapted to be opened at least in the area adjacent the bottom wall of the basket, and wherein the baskets have openings in the bottom wall thereof and the conveyor device is adapted to be brought into contact with the products through a plurality of means selected from the group consisting of small rollers and balls protruding upwardly through the openings of the bottom wall of the basket and adapted to shift the bottom wall of the basket to be inclined toward an opening side of the basket in such a way that the unloading of the products occurs as a result of the incline.

22. The unloading system of claim 21 wherein said conveyor device is a vibrating conveyor device.

23. The unloading system of claim 21 wherein the bottom walls of the basket define a grid.

24. An unloading system in combination with shopping carts which comprise an undercarriage, an upwardly open basket having a generally horizontal product-supporting bottom wall, and a plurality of generally vertical sidewalls extending upwardly from said bottom wall, said basket containing products to be unloaded lying randomly therein-on said bottom wall, said system comprising a conveyor device adapted to be operatively associated with the products to be unloaded to subject the products to a transporting movement in a defined unloading direction, wherein a side of the basket disposed in the unloading direction relative to the products is adapted to be opened at least in the area adjacent the bottom wall of the basket, and wherein the baskets have openings in the bottom wall thereof and the conveyor device is adapted to be brought into contact with the products through a plurality of means selected from the group consisting of small rollers, balls and cams protruding upwardly through the openings in the bottom wall of the basket and adapted to perform rolling or swinging movement with the aid of external drive means.

25. The unloading system of claim 24 wherein the bottom wall of the basket defines a grid.

26. The unloading system of claim 24 wherein the rolling or swinging means also perform a back and forth eccentric movement in the unloading direction of the shopping cart.

27. The unloading system of claim 24 wherein said conveyor device is a vibrating conveyor device.

* * * * *